United States Patent [19]

Miller et al.

[11] 4,331,014

[45] May 25, 1982

[54] CAN BEADING APPARATUS

[75] Inventors: Stanley J. Miller; James W. Jensen, both of Hastings; Richard J. Heniser, Grand Rapids, all of Mich.

[73] Assignee: Gulf & Western Manufacturing Company, Southfield, Mich.

[21] Appl. No.: 125,832

[22] Filed: Feb. 29, 1980

[51] Int. Cl.[3] ..... B21D 51/26

[52] U.S. Cl. ..... 72/93; 72/94

[58] Field of Search ..... 72/92, 93, 94; 113/120 V, 120 W, 120 AA, 120 M

[56] References Cited

U.S. PATENT DOCUMENTS

| | | | |
|---|---|---|---|
| 155,920 | 10/1874 | Boeklen | 72/93 |
| 748,982 | 1/1904 | Paton et al. | 72/94 |
| 996,122 | 6/1911 | Osborn . | |
| 1,485,590 | 3/1924 | Brenzinger . | |
| 1,590,333 | 6/1926 | Tevander . | |
| 1,590,334 | 6/1926 | Tevander . | |
| 1,594,657 | 8/1926 | Burns . | |
| 1,596,538 | 8/1926 | Ingram | 72/94 |
| 1,775,738 | 9/1930 | Sebell | 72/94 |
| 2,245,042 | 6/1941 | Merolle | 72/94 |
| 2,308,276 | 1/1943 | Gibbs . | |
| 2,455,768 | 12/1948 | Herman . | |
| 2,686,551 | 8/1954 | Laxo . | |
| 2,928,454 | 3/1960 | Laxo . | |
| 3,062,263 | 11/1962 | Austing et al. . | |
| 3,143,009 | 8/1964 | Pfeiffer | 72/92 |
| 3,531,967 | 10/1970 | Werge . | |
| 4,070,888 | 1/1978 | Gombas . | |
| 4,246,770 | 1/1981 | Franek et al. | 72/92 |

*Primary Examiner*—Lowell A. Larson

*Attorney, Agent, or Firm*—Meyer, Tilberry & Body

[57] ABSTRACT

Apparatus is provided for forming a chime bead adjacent the closed end of a seamless cup-shaped metal can body and a plurality of peripheral beads intermediate the opposite ends of the can body. The apparatus includes a plurality of beading spindles receiving and supporting can bodies for movement along an arcuate path. The beading spindles are provided with beading tool portions corresponding to the chime and intermediate beads to be formed on a can body. The frame supports axially offset and sequentially arranged outer beading rails positioned along the arcuate path of spindle movement. During movement of the spindles along the path between input and output stations of the apparatus, can bodies on the spindles are rotated about the spindle axes and, as each can body moves past the outer beading rails, the beading tool portions of the spindles and the outer beading rails cooperatively engage a can body therebetween to sequentially form first the chime bead and then the intermediate beads on the can body. The outer beading rails are supported on the frame of the apparatus for adjustment of the positions of the beading rails axially, laterally and radially with respect to the axis of the arcuate path of movement of the spindles.

38 Claims, 15 Drawing Figures

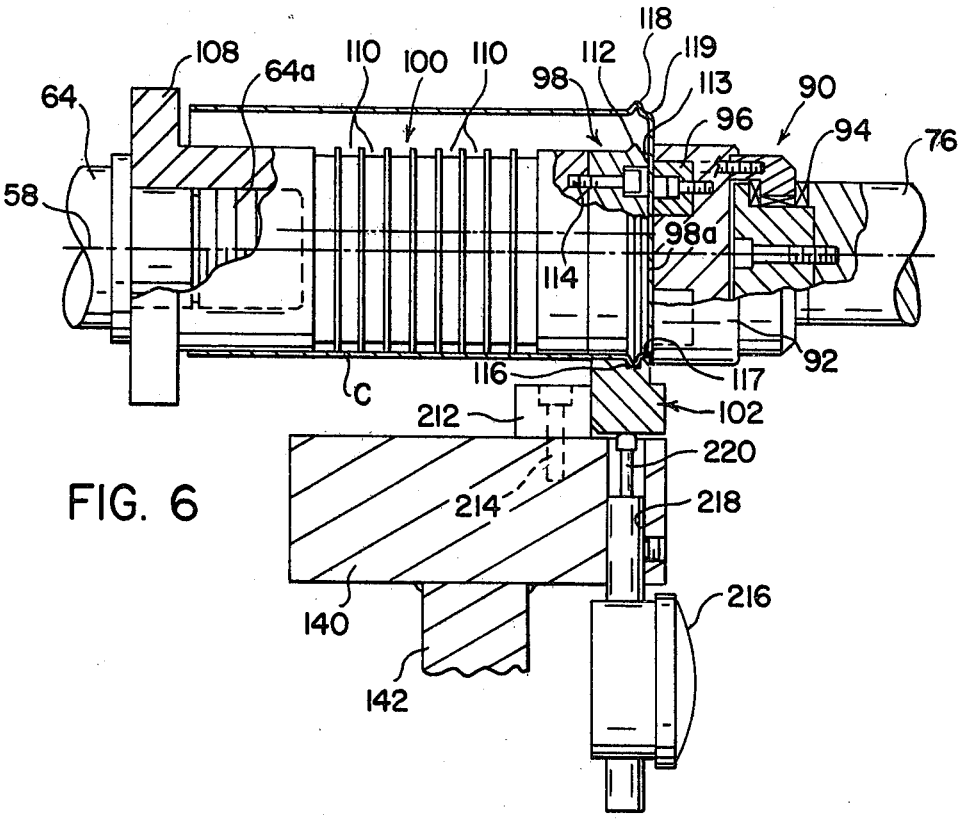
FIG. 6
FIG. 6A
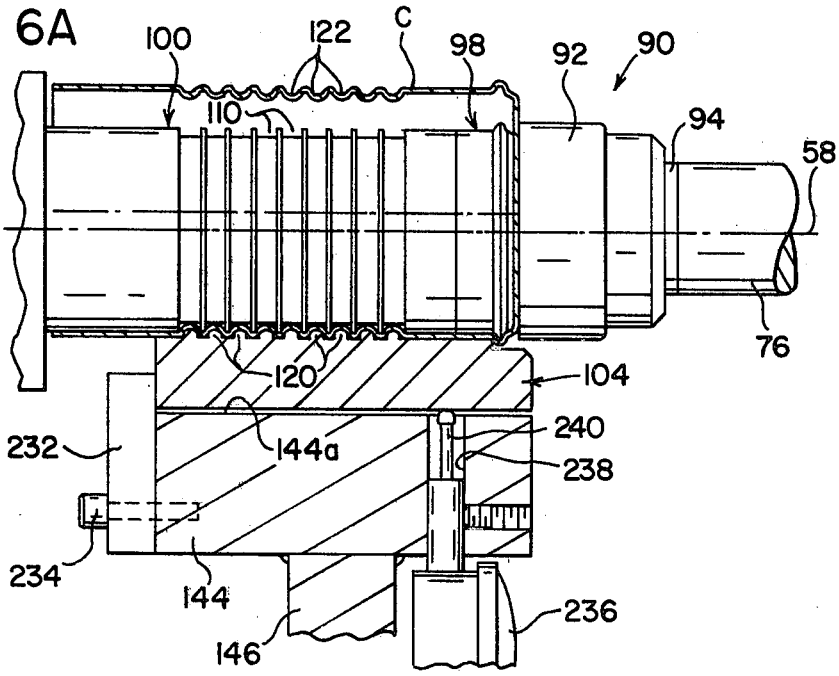

FIG. 13
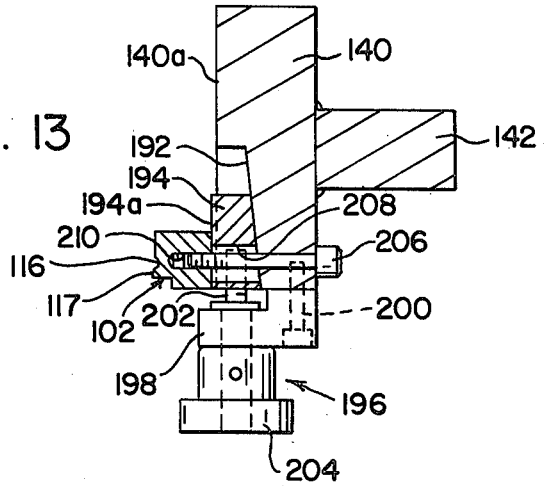
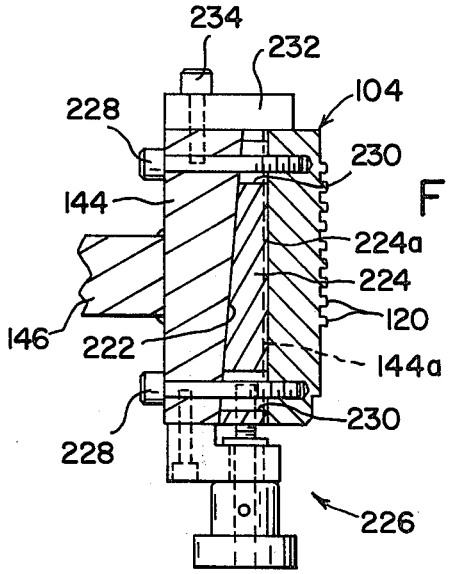
FIG. 14

CAN BEADING APPARATUS

BACKGROUND OF THE INVENTION

The present invention relates to the art of can beading apparatus and, more particularly, to apparatus for beading the wall of a seamless cup-shaped metal can body.

It is of course well known in the can making art to produce a metal can by forming an open ended tubular body and applying an end closure to each end by a flanging and beading process. It is likewise well known that the can body can be provided with a group of peripheral beads intermediate the opposite ends thereof prior to the application of the end closures thereto. When such a can is completed, the flanged and beaded seams between the can body and end closures provide rigidity for the ends of the can and the intermediate body beads provide rigidity for the can intermediate the ends thereof.

It is also well known to produce a two-piece can which includes a one-piece cup-shaped body closed at the open end by a separate end closure applied thereto in the manner employed in connection with the making of three-piece cans. Such a one-piece can body is made by drawing and ironing a cup-shaped blank to a desired axial length, and then trimming the open end so that the can bodies are the same height or axial length. During the ironing and drawing procedure, the end wall of the can body is generally domed or otherwise contoured to rigidify the end wall, and the end wall and side wall blend together about a radiused line of juncture. While the latter structure is sufficient for many uses for the can body, it will be appreciated that such a radiused line of juncture does not provide the rigidity at the corresponding end of the completed can that is achieved by the application of a separate end closure at the open end of the can body. Moreover, the side walls of such one-piece can bodies are extremely thin and, in the absence of care, can be easily dented, creased and/or crushed during handling, either before or after completion of a two-piece can using the same. These characteristics not only lead to production losses as a result of damage or distortion rendering the can body unacceptable before completing the can assembly, but also impose limitations on use and handling of the completed can which detracts therefrom as a commercially acceptable packaging unit.

Accordingly, it becomes desirable to provide peripheral beads in the side wall of a one-piece can body close to the closed end thereof and between the open and closed ends to improve the rigidity in the side wall area adjacent the closed end and to rigidify the side wall so that the overall rigidity of a two-piece can made therewith is improved. Such rigidity advantageously enables handling of the can body during production of the two-piece can, and handling the completed can such as by store merchants or customers, with reduced likelihood of damage to the can body or completed can, thus reducing production losses for the can manufacturer and merchandise losses in the market place. Further, such improved rigidity promotes versatility for two-piece cans with respect to products packaged therein, and promotes acceptability with respect to merchandising arrangements which require stacking of individual cans to considerable heights.

SUMMARY OF THE INVENTION

In accordance with the present invention, apparatus is provided for peripherally beading a one-piece metal can body to enable improving the structural characteristics thereof and thus the structural characteristics of a two-piece can produced therefrom. Commercial feasibility and acceptability of one-piece can bodies requires high production rates, and can bodies free of scratches or other surface defects or distortion. In connection with achieving these characteristics, the apparatus according to the present invention is structually simple and reliable in operation, and is operable continuously and with minimum down time for maintenance operations. Moreover, the component parts are readily accessible and/or removable for maintenance and replacement purposes as well as for clearing a malfunction, and the cooperable beading tooling components are not only accurately positioned relative to one another but are capable of being maintained in desired positional relationships. All of these factors contribute to minimizing down time and thus increasing the production rate capability while producing a desirable product.

More particularly in accordance with the present invention, the apparatus includes a plurality of beading spindle units adapted to be continuously rotated about their own axes and along an arcuate path about a second axis. The spindle units provide inner beading tooling and receive cup-shaped can bodies to be beaded and move the can bodies along the arcuate path past stationary outer beading tooling supported on the apparatus frame. The beading tooling is cooperable to peripherally bead the can body in first and second axial areas along the side wall of the body, the first area being closer to the closed end of the can body than is the second area. During the beading operation, the can body is axially shortened by radial displacement of the body material, which displacement and axial shortening is desirable to minimize stretching of the body material which would of course weaken the can body in the bead areas. Importantly, the outer beading tooling is sequentially arranged for the can body to be beaded in the first area and then in the second area during movement of the spindle units past the stationary outer tooling. Such sequential forming of the beads assures freedom for axial shortening of the can body material from the open end during beading in the first area. This assures a desired accuracy with respect to the peripheral contour of the beading closest to the closed end of the can body, avoids stretching of the material in the end wall, and avoids distortion of the can body adjacent the closed end thereof. More particularly in this respect, if the beading in the first and second areas are formed simultaneously, it becomes very difficult to produce beading adjacent the closed end which in its peripheral entirety is transverse to the axis of the can body. In this respect, the bead forming is circumferentially progressive about the can body and, if the body material is simultaneously engaged between the tooling for both bead areas, it is very difficult to pull the material of the body axially toward the closed end. Therefore, simultaneous forming of the first and second areas of beading often results either in stretching of the body material in the area therebetween and/or the forming of beading in the first area in which the starting and finishing ends thereof are axially misaligned. Stretching of the body material is of course undesirable because of the weakening effect thereof, and axial misalignment with respect to the ends of beading close to the closed end of the can body can distort the desired transverse orientation between the end wall and side wall of the can body, causing the can body to lean when it is placed on a horizontal support surface. Moreover, such stretching and/or axial misalignment of bead ends distracts from the desired aesthetic appearance of the can body. All of these problems are avoided by first forming the beading closest to the closed end of the can body and then forming the beading in the second area on the can body. In accordance with the preferred embodiment of the invention, the beading in the first area is a single peripheral chime bead in the area of juncture between the side wall and bottom wall of the can body, and the beading in the second area is a plurality of axially adjacent beads spaced from the chime bead and located intermediate the opposite ends of the can body.

In accordance with another aspect of the present invention, the beading tooling on the spindle units is positively rotated during the beading operations to eliminate potential slippage between the can body and beading tooling which can cause fracturing and/or scratching of the can body material. Further, the beading spindles are preferably axially fixed relative to the outer beading tooling so that the can bodies are stabilized against axial displacement during the beading operations. In this respect, any axial free play between the beading spindles and outer beading tooling is minimized, thus to avoid inaccuracies with respect to initial interengagement between the inner and outer beading tools and relative axial movement therebetween during the beading operations, either or both of which could result in fracturing or scratching of the can body material and/or distortion of the bead contours.

Further in connection with the beading of one-piece can bodies, accuracy of the positioning of the beading tools relative to one another is important in connection with obtaining the desired accuracy with respect to the peripheral contours of the beads while avoiding potential problems in connection with stretching, fracturing and/or scratching of the can body material. Moreover, in conjunction with the high speed operation desired for such apparatus, for example up to eight hundred cans per minute on a ten spindle machine, the ability not only to obtain but to maintain tooling accuracy with minimum down time for the apparatus is desirable. In accordance with yet another aspect of the present invention, such accuracy is obtained and maintainable with minimum effort and down time by providing for adjustment of the outer beading tooling relative to the main axis of the apparatus and thus the inner beading tooling. Preferably, such adjustment capability enables adjustment of the outer beading tooling axially, laterally and radially with respect to the main axis of the apparatus, and enables accurate determination of the tooling positions during adjustment thereof.

It is accordingly an outstanding object of the present invention to provide apparatus for beading the side wall of a one-piece cup-shaped metal can body in first and second axial areas along the side wall and in which the first area is closest to the closed end of the can body.

Another object is the provision of apparatus of the foregoing character in which the beading in the first and second areas are sequentially formed to optimize accuracy with respect to the bead contours and to minimize stretching, distortion and damage of the can body material.

A further object is the provision of apparatus of the foregoing character in which axially fixed positively rotated inner beading spindles carry can bodies to be beaded past sequentially arranged outer beading tooling supported on the apparatus frame for cooperation with the spindles to sequentially form beads in the first and second areas of the can bodies.

Another object of the present invention is the provision of apparatus of the foregoing character for forming a chime bead adjacent the closed end of the can body and one or more beads spaced therefrom and intermediate the opposite ends of the can body.

Still a further object is the provision of apparatus of the foregoing character which enables obtaining and maintaining positional accuracy between the inner and outer beading tooling.

Still another object is the provision of apparatus for beading a one-piece cup-shaped can body which is efficient in operation, operable with a high degree of accuracy with respect to the positioning of the beading tooling and thus the bead contours, which requires minimum maintenance efforts to maintain tooling accuracy, and is operable at a desired high output capacity.

BRIEF DESCRIPTION OF THE DRAWING

The foregoing objects, and others, will in part be obvious and in part pointed out more fully hereinafter in conjunction with the written description of preferred embodiments illustrated in the accompanying drawings in which:

FIG. 6 is a cross-sectional view of the chime beading rail of the apparatus, taken along line 6—6 in FIG. 4;

FIG. 6A is a cross-sectional view of the intermediate beading rail taken along line 6A—6A in FIG. 4;

FIG. 13 is a cross-sectional view of the arrangement for radially adjusting the chime beading rail, taken along line 13—13 in FIG. 7; and, FIG. 14 is a cross-sectional view of the arrangement for radially adjusting the intermediate beading rail, taken along line 14—14 in FIG. 7.

DESCRIPTION OF PREFERRED EMBODIMENTS

Figure 1:
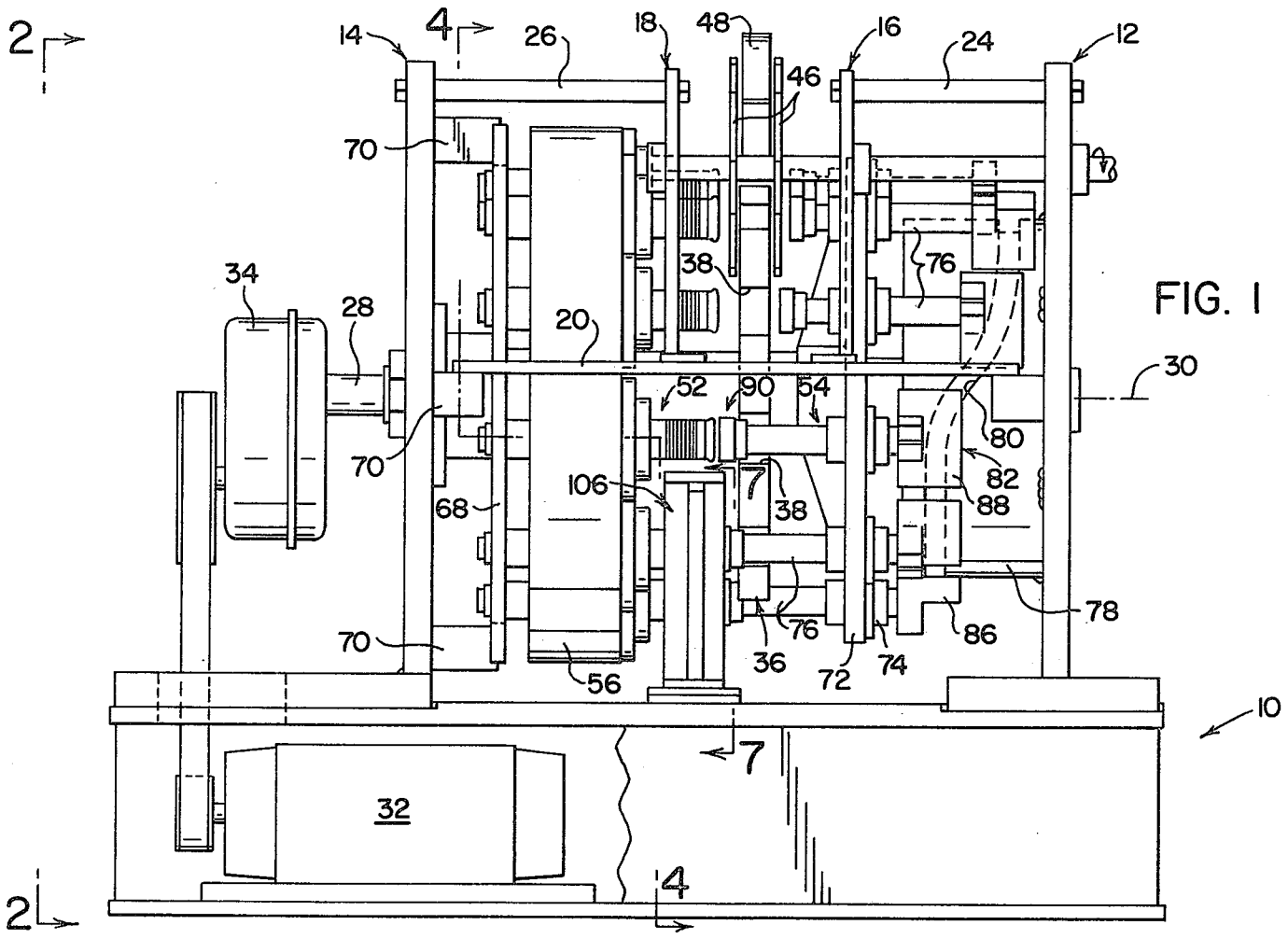
FIG. 1 is a side elevation view of beading apparatus in accordance with the present invention.
Figure 2:
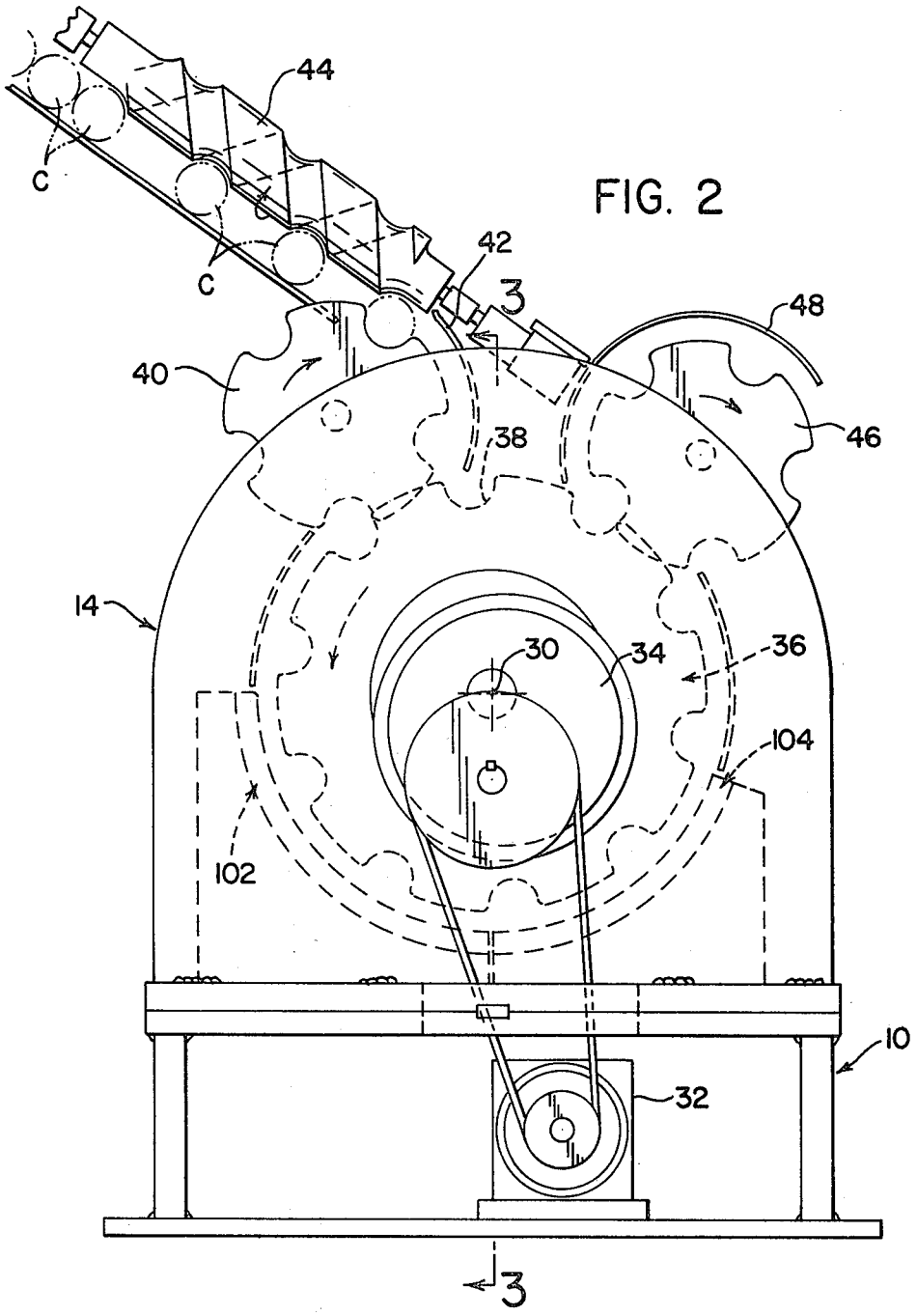
FIG. 2 is an end elevation view of the apparatus, looking in the direction from left to right in FIG. 1.

Referring now in greater detail to the drawings wherein the showings are for the purpose of illustrating preferred embodiments of the invention and not for the purpose of limiting the invention, FIGS. 1–4 illustrate in general the structure of apparatus for beading a one-piece cup-shaped metal can body in accordance with the present invention. With reference to the latter Figures, the apparatus includes a frame having a box-like base portion 10 supporting upright end plate members 12 and 14 adjacent opposite ends of the base portion 10. The frame further includes upright arcuate shaped frame plates 16 and 18 intermediate end plates 12 and 14. Frame plates 16 and 18 have their lower opposite ends suitably interconnected with longitudinally extending frame members 20 and 22 which extend between end plates 12 and 14, and the upper ends of frame plates 16 and 18 are respectively interconnected with end plates 12 and 14 by means of tie rods 24 and 26. A drive shaft 28 extends between frame plates 12 and 14 and is rotatably supported relative thereto by suitable bearing assemblies, not designated numerically, which are interposed between the drive shaft and end plates. Drive shaft 28 rotates about a horizontal axis 30 which defines the main axis for the apparatus, and is driven by a motor 32 through a gear box 34, the output side of which is suitably coupled with drive shaft 28.

A can body receiving starwheel 36 is keyed or otherwise mounted on drive shaft 28 for rotation therewith and is located intermediate frame plates 16 and 18. The outer periphery of wheel 36 is provided with a plurality of radially outwardly open pockets 38 each adapted to receive and initially support a can body C to be beaded. More particularly in this respect, the apparatus includes a can body input starwheel 40 rotated in coordination with starwheel 36 and cooperable with a guide plate 42 to receive can bodies from an input screw conveyor 44 and to guide the can bodies into pockets 38 of starwheel 36. The apparatus further includes a discharge starwheel 46 and a cooperable output guide plate 48 for receiving beaded can bodies from the pockets of starwheel 36 and discharging the same from the apparatus. Such input and discharge arrangements are well known in the art of can making machinery, and a more detailed disclosure of the structure and operation thereof is not necessary for understanding the present invention.

Figure 3:
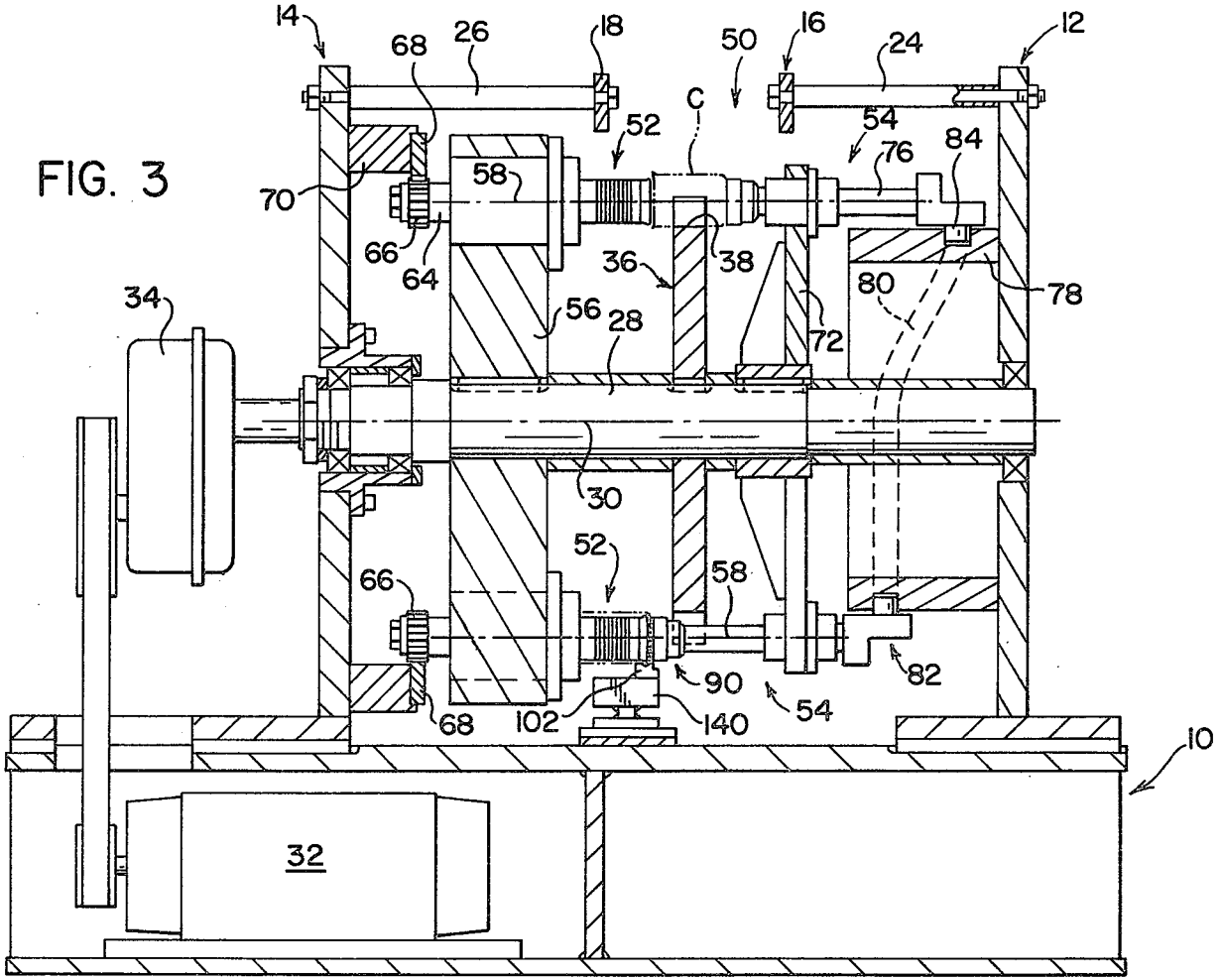
FIG. 3 is a sectional elevation view of the apparatus, taken along line 3—3 in FIG. 2.
Figure 4:
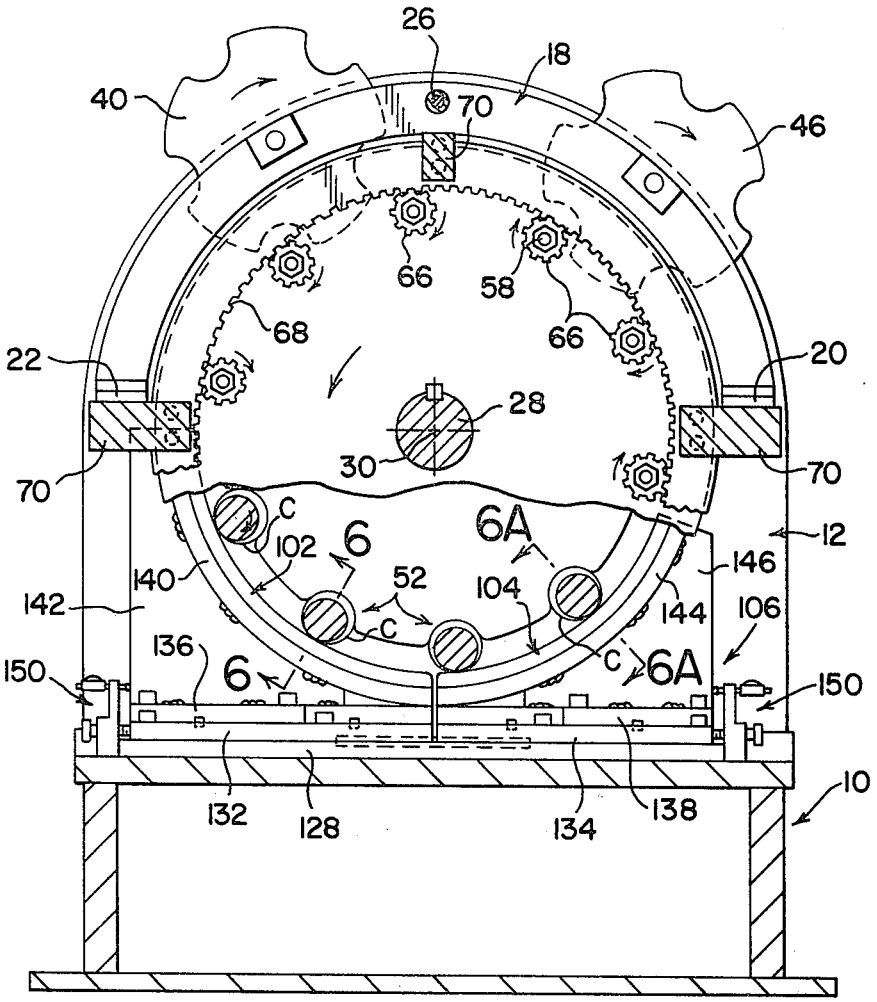
FIG. 4 is a sectional elevation view of the apparatus, taken along line 4—4 in FIG. 1.
Figure 5:
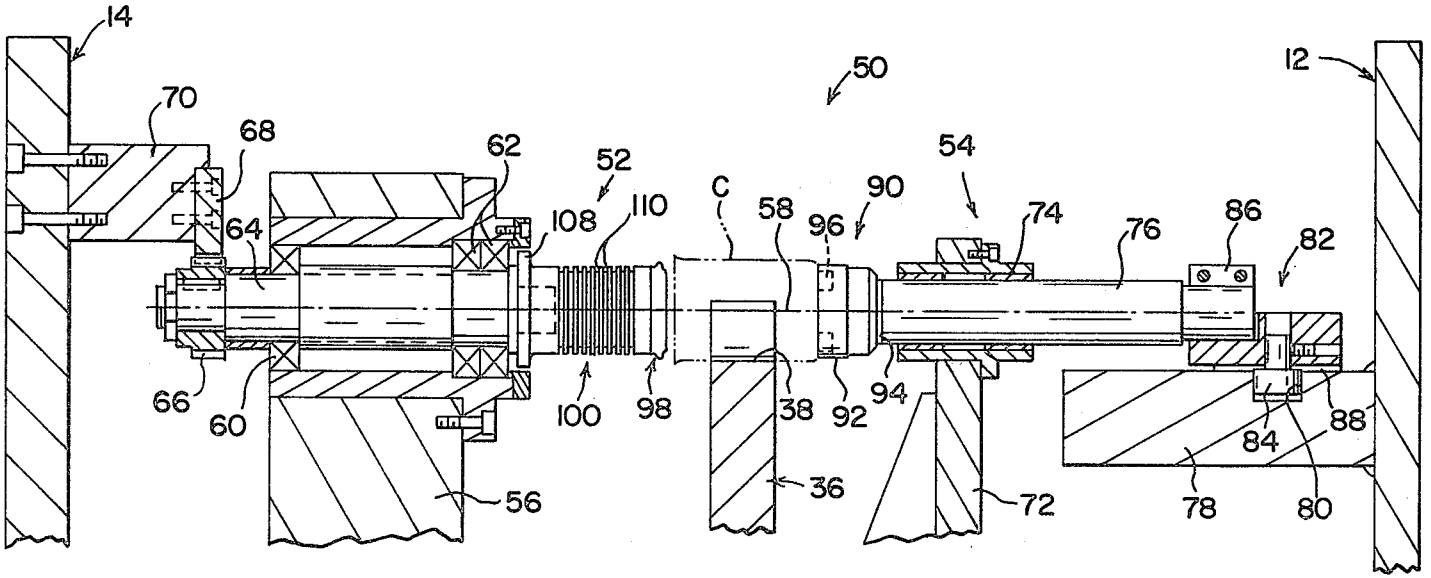
FIG. 5 is an enlarged sectional elevation view of a spindle unit of the apparatus.

As further seen in FIGS. 1–4, and as shown in detail in FIG. 5, the apparatus includes a plurality of spindle units 50 circumferentially spaced apart about main axis 30. Each spindle unit includes a beading spindle 52 and an axially opposed can body displacing and holding spindle 54. Beading spindles 52 are mounted on a turret wheel 56 which is keyed or otherwise secured to drive shaft 28 for rotation therewith, and each beading spindle is supported on turret wheel 56 for rotation relative thereto about a corresponding spindle unit axis 58 by bearing assemblies 60 and 62 interposed between turret wheel 56 and spindle shafts 64. Rotation of each spindle shaft 64 about the corresponding spindle axis 58 is achieved by providing the outer end of the spindle shaft with a pinion 66 which engages an internally threaded annular ring gear 68 mounted on frame plate 14 by means of mounting blocks 70.

Each can body displacing and holding spindle 54 is supported on a turret wheel 72 which is keyed or otherwise secured to drive shaft 28 for rotation therewith. Further, each spindle 54 is supported for axial displacement relative to turret wheel 72 and toward and away from the corresponding beading spindle 52 by means of a bearing sleeve arrangement 74 interposed between turret wheel 72 and the spindle shaft 76. Axial displacement of each spindle shaft 76 is achieved by means of an annular cam ring 78 mounted on frame plate 12 and having a cam recess 80 extending about the periphery thereof, and a cam follower assembly 82 mounted on the outer end of spindle shaft 76 and including a follower roller 84 riding in recess 80. Cam follower assembly 82 is mounted on spindle shaft 76 by means of a mounting bracket 86 which carries the follower roller and includes a pair of bearing plates 88 which extend in circumferentially opposite directions with respect to spindle unit axis 58. Plates 88 ride on the outer surface of cam ring 78 to restrain rotation of spindle shaft 76 about the spindle unit axis. The inner end of spindle shaft 76 is provided with a head assembly 90 including a magnet carrier 92 which is supported on the end of the spindle shaft for rotation relative thereto by suitable bearings including thrust bearings 94. The outer face of carrier 92 is recessed to receive a plurality of permanent magnet elements 96 circumferentially spaced apart about spindle unit axis 58. During operation of the apparatus, as set forth more fully hereinafter, head assembly 90 engages the closed end of a can body C to push the latter from its pocket in starwheel 36 onto the corresponding beading spindle 52, whereupon the can body and head assembly 90 rotate about spindle unit axis 58 as the spindle supporting turrets 56 and 72 rotate about main axis 30 during the beading operation. After the beading operation, spindle 54 is retracted and magnets 96 operate to pull the beaded can body back into the starwheel pocket for discharge from the machine at the output station thereof. While magnets are employed in the preferred embodiment and accordingly require the metal can bodies to be of magnetic material, it will be appreciated that other arrangements, such as suction through the head assemblies, could be used to achieve the withdrawal of non-magnetic material can bodies from the spindles 52.

As best seen in FIGS. 4, 5, 6 and 6A of the drawing, the beading tooling for the apparatus includes inner beading tools 98 and 100 on spindle shaft 64 of each beading spindle 52, and outer beading rails 102 and 104 extending along an arcuate path spaced from main axis 30. As seen in FIG. 4, beading rails 102 and 104 are supported on the frame by a tooling support assembly 106, which is described in greater detail hereinafter. Beading tool 100 is in the form of a sleeve having a flange 108 at one end thereof, and the sleeve is internally threaded at the latter end for threaded interengagement with externally threaded outer end **64*a* of spindle shaft 64. The sleeve is provided intermediate its opposite ends with a plurality of recesses 110 axially spaced apart from one another and extending peripherally of the sleeve transverse to the spindle unit axis 58. It will be appreciated that the number of recesses 110 corresponds to the number of peripheral beads which it is desired to form in a can body blank intermediate the opposite ends thereof. Beading tool 98 is an annular member provided on its axially outer end with a circumferentially extending beading flange 112 which projects radially outwardly with respect to the outer surface of tool 100. Preferably flange 112 is spaced axially inwardly from outer end face 98*a* of beading tool 98, and end face 98*a* and flange 112 are interconnected by tooling surface 113. For the purpose set forth hereinafter, tooling surface 113 converges with respect to spindle axis 58 at an angle of about 10° and in the direction from flange 112 toward end face 98***a*. Beading tool 98 is mounted on the outer face of tool 100 for rotation therewith by means of a plurality of threaded fasteners 114.

As seen in FIG. 6 of the drawing, outer beading rail 102 includes a radially outwardly extending recess 116 and in accordance with the preferred embodiment, a tooling surface 117 which converges with respect to spindle axis 58 at an angle of 10°. It will be appreciated that the recess 116 and tooling surface 117 extend between the opposite ends of the rail. Outer beading rail 102 is supported on the apparatus frame by tooling support assembly 106 so that recess 116 and surface 117 are axially aligned respectively with beading flange 112 and tooling surface 113. Rail 102 is also radially positioned with respect to the beading spindle for flange 112 and recess 116 to cooperatively interengage a can body on beading mandrel 52 to form a radially outwardly projecting bead 118 adjacent the closed end of the can body, and for tooling surfaces 113 and 117 to cooperatively interengage the can body to form a generally frusto-conical surface 119 between bead 118 and the end wall of the can body. Bead 118 and surface 119 together provide the can body with a chime bead which advantageously facilitates vertical stacking of completed two-piece cans. In this respect, when an end closure is applied to the open end of the beaded can body, the end closure is located axially inwardly of the endmost edge of the can as defined by the rolled seam between the can body and end closure. In stacking the cans, the portion of the chime bead immediately adjacent the bottom of an upper can often frictionally engages the rolled seam of the can therebeneath. Thus, the cans become frictionally interengaged requiring manual separation, or causing the lower can to be picked up with and then dropped from the upper can onto a floor or the like therebeneath, both of which results are undesirable. The angled surface 119 advantageously provides a radial clearance with respect to the rolled seam of the completed can, thus avoiding such frictional interengagement of stacked cans.

As seen in FIG. 6A, outer beading rail 104 is provided with a plurality of radially inwardly extending beading projections 120 which are co-extensive between the circumferentially opposite ends of the beading rail and are axially spaced apart and parallel to one another along the length thereof. It will be appreciated that tooling support assembly 106 supports outer beading rail 104 in axial alignment with recesses 110 in inner beading tool 100 and in radial relationship relative thereto such that a plurality of intermediate beads 122 are formed on can body C during movement of mandrel 52 along outer beading rail 104. While nine such intermediate beads are shown in connection with the preferred embodiment, it will be appreciated that the number of such beads can vary, and that the number desired will depend on several factors including the axial length of the can body and the intended use thereof.

With reference now to FIGS. 3 and 4 of the drawing, in light of the foregoing description of the component parts of the can beading apparatus, the operation thereof with respect to the beading of a can body is as follows. Turret wheels 56 and 72 and can body supporting starwheel 36 are continuously rotated with drive shaft 28 in a counterclockwise direction as viewed in FIG. 4. Thus, spindle units 50 continuously move along an arcuate path about main axis 30, and beading spindles 52 are continuously rotated about spindle unit axes 58 as a result of the meshing engagement of pinions 66 with ring gear 68. Each time an empty spindle unit 50 moves past input starwheel 40, a can body to be beaded is introduced into the corresponding pocket of starwheel 36 of the spindle unit. As the spindle unit moves counterclockwise toward chime beading rail 102, cam track recess 80 in cam ring 78 causes can displacing and holding spindle 54 to be displaced to the left in FIG. 3, thus pushing the can body axially onto the corresponding beading spindle 52 for the closed end of the can body to engage against the outer face of the beading mandrel. The contour of cam track recess 80 is such that the displacing and holding spindle 52 remains in the extended position thereof to hold the can body of the beading spindle throughout the beading operation. As soon as the closed end of the can body engages beading spindle 52, the can body rotates with the beading spindle and, as a result of the relative rotational interengagement between head assembly 90 and spindle shaft 76 of a can body displacing and holding spindle 54, head assembly 90 also rotates with the can body.

Continued rotation of the spindle support turrets counterclockwise as seen in FIG. 4 moves the rotating beading spindle 52 and the can body thereon onto and along outer chime beading rail 102, whereby the chime bead is rolled into the can body and, in this respect, it will be appreciated that pinion 66 and ring gear 68 interengage to rotate beading spindle 52 clockwise as viewed in FIG. 4 whereby the beading spindle in effect rolls along beading rail 102. To assure the desired accuracy in contour and orientation of the chime bead in view of the amount of can body material axially displaced to achieve formation of the bead, outer chime beading rail 102 has a circumferential extent of about 90° which provides for two complete revolutions of beading spindle 52 during movement thereof along the beading rail. When beading spindle 52 and the can body thereon reach the end of chime beading rail 102, the spindle and can body move onto the entrance end of outer beading rail 104, whereby the intermediate beads 122 are rolled into the can body. Preferably, leading rail 104 has an arcuate extent of about 70° to assure more than one complete revolution of beading spindle 52 during movement thereof along the latter beading rail. Between the exit end of beading rail 104 and discharge starwheel 46, cam track recesses 80 causes retraction of the can body displacing and holding spindle 54 to the right as viewed in FIG. 3, whereby the beaded can body is pulled back into starwheel pocket 38 as the result of the magnetic coupling between the closed end of the can body and magnets 96 on head assembly 90. The completed can body then is introduced into a pocket of discharge starwheel 46 and is stripped from magnetic retention on head assembly 90 by the end of discharge guide plate 48 which is interposed in the path of movement of the can body. The can body is then discharged from the apparatus by the discharge starwheel. As mentioned hereinabove, the feeding, beading and discharging operation of the apparatus is continuous and, with ten spindle units as illustrated in the preferred embodiment, the machine has a production capacity of about eight-hundred cans per minute.

In order to assure continuous accuracy with respect to the chime and intermediate beads, especially in connection with a high output rate such as that referred to above, it becomes important to both obtain and maintain alignment accuracy between the inner beading tools on the beading spindles and the outer beading rails. In accordance with another aspect of the present invention, such accuracy is obtained and maintained through adjustment capabilities for the outer beading rails provided in connection with the tooling support assembly 106 therefor. More particularly, as shown in FIGS. 7–14 of the drawing, support assembly 106 includes a base plate 128 adapted to be securely fastened to the apparatus frame by means of a plurality of threaded fasteners extending through openings 130 in the base plate. Preferably, beading rails 102 and 104 are individually adjustable relative to main axis 30 of the apparatus and, accordingly, support assembly 106 includes a pair of adjusting plates 132 and 136 underlying beading rail 102 and a pair of adjusting plates 134 and 138 underlying beading rail 104. Beading rail 102 is mounted on an arcuate support plate 140, in a manner described more fully hereinafter, and support plate 140 is rigidly interconnected with adjusting plate 136 by means of upstanding gusset plate 142 which is suitably secured to plates 136 and 140, such as by welding. Similarly, beading rail 140 is mounted on an arcuate support plate 144 which is rigidly interconnected with adjusting plate 138 by means of an upstanding gusset plate 146 which is secured to plates 138 and 144 such as by welding.

Figure 7:
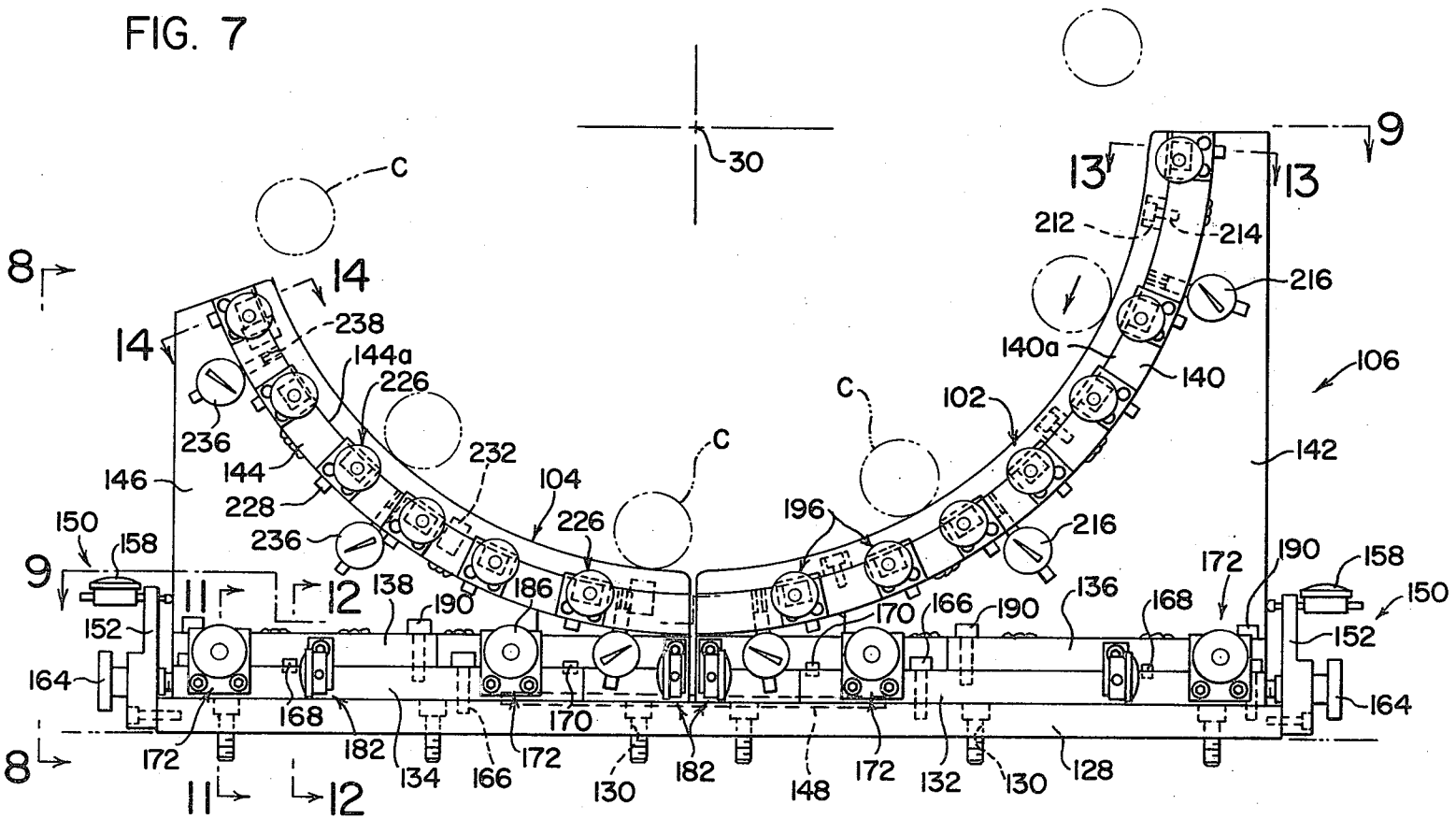
FIG. 7 is an enlarged end elevation view of the outer tooling assembly taken along line 7—7 in FIG. 1.
Figure 10:
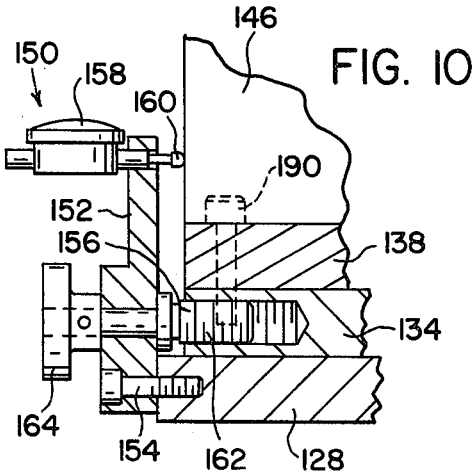
FIG. 10 is a cross-sectional elevation view of the adjusting and gauging arrangement for laterally adjusting the tooling, taken along line 10—10 in FIG. 8.
Figure 9:
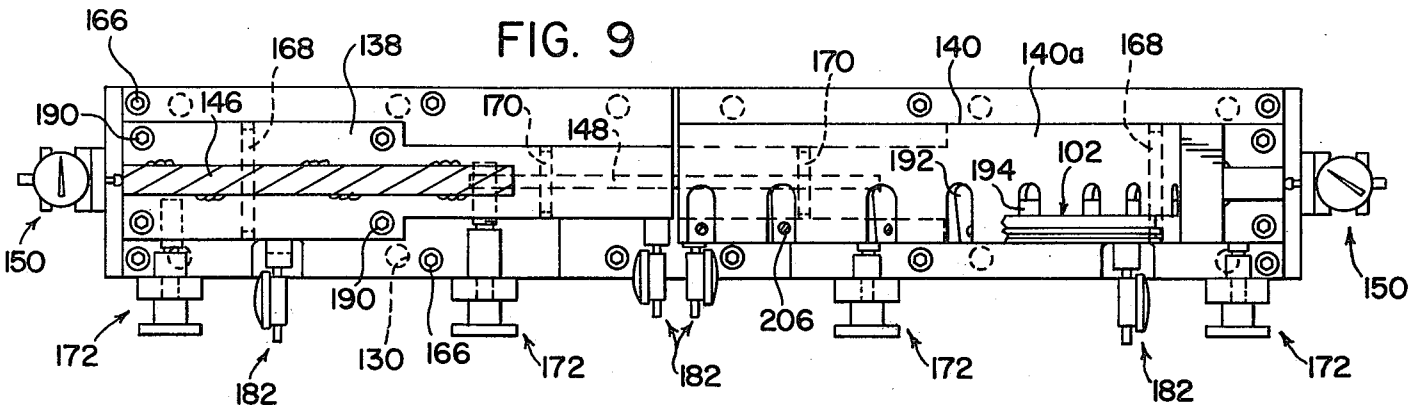
FIG. 9 is a cross-sectional view of the tooling assembly, taken along line 9—9 in FIG. 7.

Each of the adjusting plates 132 and 134 is interengaged with base plate 128 for displacement relative thereto laterally with respect to axis 30. In this respect, base plate 128 and each of the adjusting plates 132 and 134 are provided with laterally extending and vertically aligned recesses providing a keyway receiving a laterally extending key 148. It will be appreciated that key 148 provides guidance for lateral displacement of plates 132 and 134 and restrains displacement of the plates longitudinally of plate 128 and thus axis 30. The laterally opposite ends of base plate 128 are provided with adjusting and gauging assemblies 150 operable to displace the corresponding one of the adjusting plates 132 and 134 laterally relative to plate 128 and thus axis 30 and to gauge the extent of displacement of the plates. As best seen in FIGS. 7 and 10, each of the assemblies 150 includes a mounting bracket 152 attached to base plate 128 by means of threaded studs 154, an adjusting plate screw 156 rotatably supported by the bracket, and a dial type feeler gauge 158 mounted on the bracket and having an actuating stem 160 engaging the outer edge of the corresponding one of the gusset plates 142 and 146. Adjusting screw 156 has a threaded inner end 162 received in a cooperatively threaded bore in the end of the corresponding one of the adjusting plates 132 and 134. The outer end of each adjusting screw is provided with an actuating knob 164, and it will be appreciated that rotation of knobs 164 in opposite directions results in lateral displacement of the corresponding one of the adjusting plates 132 and 134 and thus beading rails 102 and 104 in laterally opposite directions relative to axis 30. Each of the adjusting plates 132 and 134 is provided with threaded fasteners 166 extending loosely through openings therethrough and into threaded engagement with base plate 128 to lock the adjusting plates 132 and 134 and thus beading rails 102 and 104 in an adjusted position, and to release the plates for lateral displacement in the foregoing manner.

Figure 8:
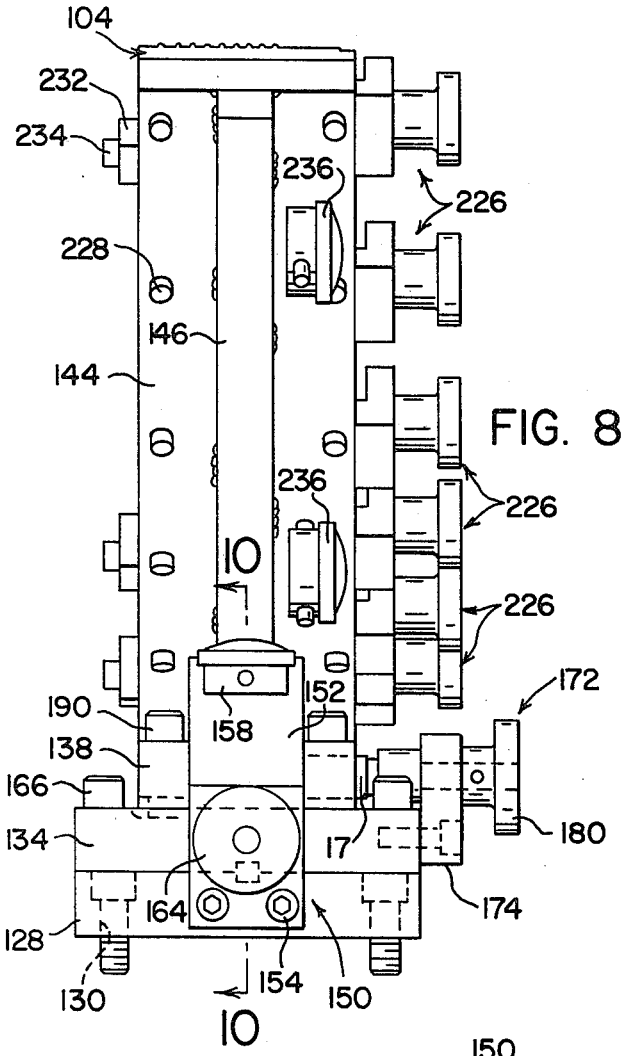
FIG. 8 is an end elevation view of the tooling assembly, looking in the direction from left to right in FIG. 7.
Figure 11:
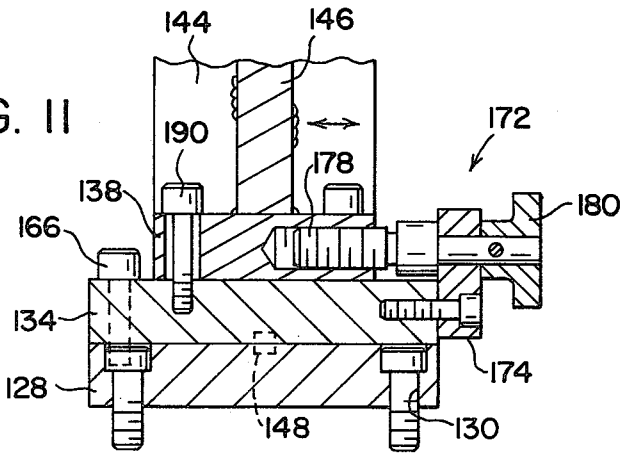
FIG. 11 is a cross-sectional elevation view of the arrangement for axially adjusting the tooling, taken along line 11—11 in FIG. 7.

Each of the adjusting plates 136 and 138 is interengaged with the underlying one of the adjusting plates 132 and 134 for displacement relative thereto axially or longitudinally with respect to axis 30. In this respect, plates 132 and 136 and plates 134 and 138 are provided with axially extending keyways for corresponding outer and inner keys 168 and 170. It will be appreciated that keys 168 and 170 provide guidance for axial displacement of adjusting plates 136 and 138 relative to plates 132 and 134, and restrain lateral displacement of plates 136 and 138 relative to plates 132 and 134. Further, each of the adjusting plates 132 and 134 is provided adjacent the laterally inner and outer ends thereof with adjusting assemblies 172 for displacing the corresponding one of the plates 136 and 138 longitudinally relative to axis 30. As best seen in FIGS. 7, 8 and 11, each adjusting assembly 172 includes a mounting bracket 174 attached to the side of the corresponding one of the adjusting plates 132 and 134, and an adjusting screw 178 rotatably supported by bracket 174. The inner end of adjusting screw 178 is threaded and received in a cooperatively threaded bore in the corresponding one of the adjusting plates 136 and 138, and the outer end of the screw is provided with an actuating knob 180. Accordingly, it will be appreciated that rotation of the adjusting screws in opposite directions enables axial adjustment of the corresponding one of the adjusting plates 136 and 138 and thus the bearing rails 102 and 104 axially relative to the underlying adjusting plates and thus axis 30 of the machine.

Figure 12:
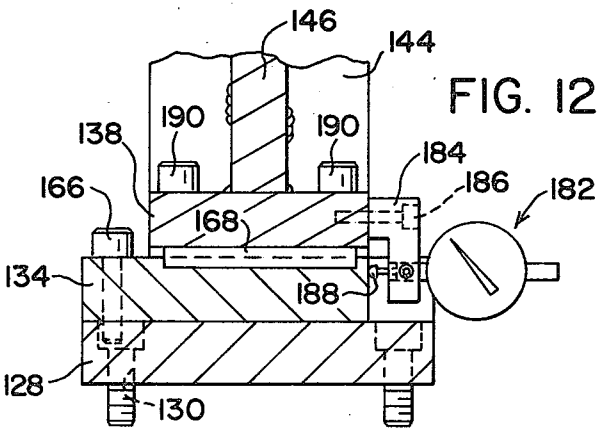
FIG. 12 is a cross-sectional elevation view taken line 12—12 on FIG. 7 and showing the gauging arrangement associated with axial adjustment of the tooling.

Each of the adjusting plates 136 and 138 is provided adjacent the laterally opposite ends thereof with dial type gauges 182. As shown in FIG. 12 in connection with adjusting plate 138, dial gauges 182 are mounted on the axially displaceable adjusting plate for displacement therewith by means of a mounting bracket 184 secured thereby by a threaded fasteners 186, and the gauge is supported by the bracket for actuating stem 188 thereof to engage the underlying laterally displaceable adjusting plate. Further, each of the adjusting plates 136 and 138 is provided with a plurality of threaded fasteners 190 extending loosely through openings therethrough and into threaded engagement with openings in the underlying one of the adjusting plates 132 and 134. Fasteners 190 are operable to secure adjusting plates 136 and 138 and thus beading rails 102 and 104 in an adjusted position, and to release the adjusting plates 136 and 138 for displacement axially relative to the underlying adjusting plate and base plate in the manner described above.

In addition to the foregoing arrangements for achieving lateral and axial adjustment of the beading rails relative to main axis 30, each of the beading rails is radially adjustable relative to axis 30. In this respect, with regard first to chime beading rail 102, and as will be seen from FIGS. 7, 9 and 13 of the drawing, arcuate support plate 140 is provided along inner surface **140*a* thereof with a plurality of axially extending recesses 192 having bottom walls which are inclined relative to inner surface 140*a*. Each recess 192 receives a corresponding wedge member 194 which is axially slidable relative to the recess and includes an outer surface 194*a* adapted to be displaced radially inwardly and outwardly relative to inner surface 140*a* in response to displacement of the wedge in axially opposite directions relative to recess 192. Beading rail 102 overlies recesses 192 and wedge members 194 therein, whereby such axial displacement of the wedge members is operable to displace the beading rail radially with respect to main axis 30. Each of the wedge members 194 is adapted to be axially displaced relative to support plate 140 by a corresponding adjusting assembly 196 including a bracket member 198 attached to support plate 140 by means of threaded fasteners 200. An adjusting screw 202 is supported by bracket 198 for rotation relative thereto, and the inner end of screw 202 is threaded and received in a cooperatively threaded recess in wedge 194. The outer end of screw 202 is provided with an actuating knob 204 by which the screw is adapted to be rotated in opposite directions to axially displace wedge member 194 relative to support plate 140**.

Beading rail 102 is mounted on support plate 140 by means of a plurality of threaded fasteners 206 preferably associated with the wedge members so as to facilitate clamping the wedge members against axial displacement, thus locking beading rail 102 in the desired radial position thereof. In this respect, each of the threaded fasteners 206 extends through an opening in support plate 140, an axially enlarged slot 208 in the corresponding wedge member 194, and into a threaded recess 210 opening into the underside of beading rail 102. Recess 208 in the wedge member allows axial displacement thereof relative to fastener 206, and the location of the fastener to extend through the wedge member advantageously provides for the beading rail 102 to clampingly engage the wedge member against the bottom wall of the wedge recess. Clamping in this manner optimizes the application of the clamping force with respect to the wedge and, thus, optimizes maintaining the wedge and therefore beading rail 102 in a desired position of adjustment. A number of rail positioning blocks 212 are attached to support plate 140 along the length thereof by corresponding threaded fasteners 214. Blocks 212 engage the axially inner side of beading rail 102 to axially position the beading rail relative to support plate 140. With further regard to radial adjustment of beading rail 102, a plurality of dial type gauges 216 are mounted in radially extending openings 218 provided through support plate 140 along the length thereof. The actuating stems 220 of gauges 216 engage the underside of beading rail 102, thus enabling accurate determination of the radial position of the beading rail relative to support plate 140 and thus main axis 30 of the machine.

As will be seen from FIGS. 7 and 14 of the drawing, beading rail 104 is radially adjustable relative to main axis 30 by axially displaceable wedging arrangements similar to those described hereinabove with regard to beading rail 102, except for the axial dimensions of the wedge members and the recesses therefor. In this respect, the axial dimension of beading rail 104 is considerably greater than that of chime beading rail 102 and, in the embodiment illustrated, is axially coextensive with the underlying arcuate support plate 144. Accordingly, support plate 144 is provided with a plurality of axially extending recesses 222 which extend axially through support plate 144, and each of the recesses is provided with a corresponding wedge member 224 having an axial dimension generally corresponding with that of the recess and beading rail 104. As in the wedging arrangement described with regard to beading rail 102, the bottom of each recess 122 is inclined with respect to inner surface **144*a* of support plate 144, whereby axial displacement of wedge member 224 relative to the recess radially displaces outer surface 224*a* of the wedge member relative to outer surface 144*a* of support plate 144. Such radial displacement of wedge surface 224*a* radially displaces beading rail 104 relative to support plate 144 and thus main axis 30**.

Axial adjustment of each wedge member 224 is achieved by a corresponding adjusting assembly 226 mounted on support plate 144. Each adjusting assembly 226 is structured and is operatively interengaged with the corresponding wedge member 224 in the manner described hereinabove with regard to adjusting assemblies 196 associated with support plate 140 and beading rail 102. Beading rail 104 is mounted on support plate 144 by means of pairs of threaded fasteners 228 at axially opposite ends of each wedge member. The fasteners of each pair extend through axially elongated openings 230 in the corresponding wedge member and into corresponding threaded openings in the underside of beading rail 104. A pair of threaded fasteners 228 is provided in conjunction with each of the wedges associated with beading rail 104 because of the longer axial dimension thereof, and it will be appreciated that each pair of fasteners serves the same clamping and releasing function in conjunction with wedges 224 and beading rail 104 as is provided by the fasteners 206 in connection with wedges 194 and beading rail 102. A plurality of rail positioning plates 232 are attached to the inner end of support plate 144 by means of threaded fasteners 234 to assure proper axial positioning of beading rail 104 relative to support plate 144. Further, support plate 144 is provided with a plurality of dial type gauges 236 mounted in openings 238 provided along the length of support plate 144, and the stems 240 of the gauges engage the underside of beading rail 104, thus enabling determination of the position of beading rail 104 relative to support plate 144 and thus main axis 30.

It will be appreciated from the foregoing description that each of the beading rails 102 and 104 is adapted to be adjusted independently of the other with respect to main axis 30 of the machine, and that each of the beading rails is adapted to be adjusted laterally, axially and radially with respect to axis 30. In this respect, with regard for example to beading rail 104, loosening of threaded fasteners 166 releases adjusting plate 134 for lateral displacement relative to base plate 128, whereby operating knob 164 can be rotated to displace adjusting plate 134 laterally inwardly or outwardly relative to axis 30. Beading rail 104 is rigidly supported relative to adjusting plate 134 at this time, whereby displacement of adjusting plate 134 adjusts the position of beading rail 104 laterally relative to axis 30. The extent of lateral displacement of beading rail 104 and thus the lateral position thereof relative to axis 30 is determinable from observation of the dial gauge 158. After the desired lateral position is established, fasteners 166 are displaced to secure adjusting plate 134 relative to base plate 128, and fasteners 190 can then be displaced to release adjusting plate 138 for axial or longitudinal displacement relative to adjusting plate 134, such axial displacement of plate 138 being achieved by rotating actuating knobs 172. Beading rail 104 is rigidly interconnected with adjusting plate 138 at this time and, accordingly, is displaced therewith axially relative to axis 30. The extent of axial displacement of plate 138 relative to plate 134 and thus the axial position of beading rail 104 relative to axis 30 is determinable from observation of dial gauges 182. Once the desired axial position has been achieved, fasteners 190 are displaced to clamp adjusting plate 138 in place with respect to adjusting plate 134 and base plate 128, after which threaded fasteners 228 can be displaced to release clamping engagement of wedge members 224 between beading rail 104 and support plate 144. Wedges 224 are thus released for axial displacement relative to support plate 144 to radially displace beading rail 104 relative to axis 30. Such axial displacement of wedges 224 is achieved through adjusting mechanisms 226, and the radial displacement of beading rail 104 relative to support plate 144 and thus the radial position of the beading rail relative to axis 30 is determinable from observation of dial gauges 236.

While considerable emphasis has been placed on the structures of the component parts and the structural interrelationships between the component parts of the preferred embodiment of the can beading apparatus illustrated and described herein, it will be appreciated that many modifications of the structures and structural relationships can be made without departing from the principles of the present invention. In this respect, for example, while a single chime bead and a preferred contour therefor are illustrated in connection with the preferred embodiment, it will be appreciated that other chime bead contours as well as plural beads for rigidifying the can body at the closed end thereof could readily be employed. It is only necessary in accordance with the present invention that the beading in the area closest to the closed end be formed first to facilitate axial shortening of the can body as described herein prior to forming one or more beads intermediate the opposite ends of the can body. Since many modifications will be obvious and suggested to those skilled in the art upon reading the foregoing description of the preferred embodiment, it will be distinctly understood that the foregoing descriptive matter is to be interpreted merely as illustrative of the present invention and not as a limitation.

Having thus described the invention, it is claimed:

1. Apparatus for peripherally beading the side wall of a cup-shaped metal can body having open and closed ends comprising, a frame, can body supporting beading spindle means having a spindle axis and axially arranged first and second inner beading tool means, means for supporting and moving said spindle means and a can body supported thereby in a given direction along an arcuate path relative to said frame, said arcuate path having a second axis parallel to and radially spaced from said spindle axis, means to rotate said beading spindle means and a can body supported thereby about said spindle axis during movement of said beading spindle means and can body along said path, and first and second outer beading tool means corresponding respectively to said first and second inner beading tool means and supported on said frame to extend sequentially in said given direction along said path, said first inner and outer beading tool means and said second inner and outer beading tool means being cooperable during movement of said spindle means along said path to sequentially form first and second peripheral bead means in the wall of said can body, said second bead means being between said first bead means and the open end of said can body.

2. Apparatus according to claim 1, wherein said first inner and outer beading tool means form a chime bead in the area of juncture between the side wall and closed end of said can body, and said second inner and outer beading tool means form a plurality of beads in the side wall intermediate said open and closed ends of said can body.

3. Apparatus according to claim 1, wherein said beading spindle means is axially fixed with respect to said means for supporting and moving said beading spindle means along said arcuate path, and means for moving a can body axially onto and off of said spindle means.

4. Apparatus according to claim 1, and second spindle means axially opposed to said beading spindle means, means supporting said second spindle means for movement with said beading spindle means along said arcuate path and for axial reciprocation toward and away from said beading spindle means, and means for axially reciprocating said second spindle means.

5. Apparatus according to claim 4, wherein said beading spindle means is axially fixed with respect to said means for supporting and moving said beading spindle means along said arcuate path.

6. Apparatus according to claim 5, wherein said first inner and outer beading tool means form a chime bead in the area of juncture between the side wall and closed end of said can body, and said second inner and outer beading tool means form a plurality of beads in the side wall intermediate said open and closed ends of said can body.

7. Apparatus according to claim 5, wherein said means to rotate said beading spindle means includes gear means on said frame and pinion means on said beading spindle means in meshing engagement with said gear means.

8. Apparatus according to claim 5, wherein said means to axially reciprocate said second spindle means includes cam means on said frame and cam follower means on said second spindle means.

9. Apparatus according to claim 8, wherein said means to rotate said beading spindle means includes gear means on said frame and pinion means on said beading spindle means in meshing engagement with said gear means.

10. Apparatus according to claim 5, and means to position a can body between said beading and second spindle means including means defining arcuate pocket means axially aligned with said beading and second spindle means and movable therewith along said path, said pocket means receiving said can body when said second spindle means is away from said beading spindle means, and said second spindle means displacing a can body from said pocket means onto said beading spindle means when said second spindle means moves toward said beading spindle means.

11. Apparatus according to claim 10, and means on said second spindle means to move said can body from said beading spindle means back into said pocket means when said second spindle means moves away from said beading spindle means.

12. Apparatus according to claim 11, wherein said means to rotate said beading spindle means includes gear means on said frame and pinion means on said beading spindle means in meshing engagement with said gear means, and wherein said means to axially reciprocate said second spindle means includes cam means on said frame and cam follower means on said second spindle means.

13. Apparatus according to claim 1, and means for adjusting the positions of said first and second outer beading tool means relative to said second axis.

14. Apparatus according to claim 13, wherein said adjusting means includes means for adjusting said first and second outer beading tool means laterally, axially and radially of said second axis.

15. Apparatus according to claim 13, wherein said adjusting means includes means for adjusting the position of each said first and second outer beading tool means independent of the other.

16. Apparatus according to claim 1, and further including tooling support means carrying said first and second outer beading tool means, means interengaging said tooling support means with said frame for adjustable displacement relative thereto laterally of said second axis, and means for displacing said tooling support means to laterally adjust the positions of said outer beading means relative to said second axis.

17. Apparatus according to claim 16, and gauge means for determining the lateral positions of said outer beading tool means relative to said second axis.

18. Apparatus according to claim 16, and means between said tooling support means and said first and second outer beading tool means for adjusting the positions of said outer beading tool means radially of said second axis.

19. Apparatus according to claim 18, wherein said means between said tooling support means and said first and second beading tool means includes wedge means, and means to displace said wedge means axially relative to said tooling support means and said outer beading tool means.

20. Apparatus according to claim 18, and gauge means for determining the lateral and radial positions of said outer beading tool means relative to said second axis.

21. Apparatus according to claim 1, and further including tooling support means carrying said first and second outer beading tool means, and means between said tooling support means and said first and second outer beading tool means for adjusting the positions of said outer beading tool means radially of said second axis.

22. Apparatus according to claim 21, wherein said means between said tooling support means and said first and second beading tool means includes wedge means, and means to displace said wedge means axially relative to said tooling support means and said outer beading tool means.

23. Apparatus according to claim 21, and gauge means for determining the radial positions of said outer beading tool means relative to said second axis.

24. Apparatus according to claim 21, and means interengaging said tooling support means with said frame for adjustable displacement relative thereto longitudinally of said second axis, and means for displacing said tooling support means to longitudinally adjust the positions of said outer beading tool means relative to said second axis.

25. Apparatus according to claim 24, and gauge means for determining the radial and longitudinal positions of said outer beading tool means relative to said second axis.

26. Apparatus according to claim 1, and further including tooling support means carrying said first and second outer beading tool means, and means interengaging said tooling support means with said frame for adjustable displacement relative thereto longitudinally of said second axis, and means for displacing said tooling support means to longitudinally adjust the positions of said outer beading tool means relative to said second axis.

27. Apparatus according to claim 26, and gauge means for determining the longitudinal position of said outer beading tool means relative to said second axis.

28. Apparatus according to claim 26, wherein said means interengaging said tooling support means and frame further provides for adjustable displacement of said tooling support means laterally of said second axis, and means for displacing said tooling support means to laterally adjust the positions of said outer beading tool means relative to said second axis.

29. Apparatus according to claim 28, and gauge means for determining the longitudinal and lateral positions of said outer beading tool means relative to said second axis.

30. Apparatus according to claim 28, and means between said tooling support means and said first and second outer beading tool means for adjusting the positions of said outer beading tool means radially of said second axis.

31. Apparatus according to claim 30, wherein said means between said tooling support means and said first and second beading tool means includes wedge means, and means to displace said wedge means axially relative to said tooling support means and said outer beading tool means.

32. Apparatus according to claim 30, and gauge means for determining the longitudinal, lateral and radial positions of said outer beading tool means relative to said second axis.

33. Apparatus for peripherally beading the side wall of a cup-shaped metal can body having open and closed ends comprising, a frame, can body supporting spindle means having inner beading tool means thereon, said spindle means having a spindle axis, means for supporting and moving said spindle means and a can body supported thereby along an arcuate path relative to said frame, said arcuate path having a second axis parallel to and radially spaced from said spindle axis, arcuate outer beading tool means supported on said frame and extending along said path, said outer beading tool means being positioned on said frame relative to said second axis for said inner and outer beading tool means to peripherally bead the wall of a can body on said spindle means moving therepast, and means for adjusting the position of said outer beading tool means relative to said second axis, said adjusting means including tool support means on said frame and carrying said outer beading tool means, said outer beading tool means being arcuate rail member means, and a plurality of individually axially adjustable wedges between said tool support means and rail member means, said wedges being spaced apart along said rail member means for adjusting the position of said rail member means radially of said second axis.

34. Apparatus according to claim 33, wherein said adjusting means further includes means interengaging said tool support means with said frame for displacement relative thereto laterally of said second axis, and means to displace said tool support means laterally relative to said frame to adjust the position of said rail member means laterally of said second axis.

35. Apparatus according to claim 34, wherein said means interengaging said tool support means with said frame includes means supporting said tool support means for displacement relative to said frame longitudinally of said second axis, and means to displace said tool support means longitudinally relative to said frame to adjust the position of said rail member means longitudinally of said second axis.

36. Apparatus according to claim 33, wherein said tool support means includes arcuate support plate means for said rail member means, first adjusting plate means extending laterally of said second axis, second adjusting plate means between said first adjusting plate means and said support plate means, means supporting said first adjusting plate means for displacement relative to said frame laterally of said second axis, and means to displace said first adjusting plate means to adjust the position of said rail member means laterally of said second axis.

37. Apparatus according to claim 36, and means interengaging said first adjusting plate means with said second adjusting plate means for displacement relative thereto longitudinally of said second axis, and means to displace said first adjusting plate means relative to said second adjusting plate means to adjust the position of said rail member means longitudinally of said second axis.

38. Apparatus according to claim 37, and gauge means between said rail member means and said support plate means and between said tool support means and said frame and between said first adjusting plate means and said second adjusting plate means for respectively determining the radial, lateral and longitudinal positions of said rail member means relative to said second axis.

* * * * *